US011091893B2

(12) United States Patent
Nicolas et al.

(10) Patent No.: US 11,091,893 B2
(45) Date of Patent: Aug. 17, 2021

(54) METHOD AND DEVICE FOR FREEZING A MASS OF SOIL

(71) Applicant: VINCI CONSTRUCTION, Rueil-Malmasion (FR)

(72) Inventors: Romain Nicolas, Toulouse (FR); Bertrand Thidet, Paris (FR); Raphaël Gueulet, Paris (FR); Jérôme Stubler, Paris (FR)

(73) Assignee: VINCI CONSTRUCTION, Rueil-Malmasion (FR)

( * ) Notice: Subject to any disclaimer, the term of this patent is extended or adjusted under 35 U.S.C. 154(b) by 0 days.

(21) Appl. No.: 16/611,019

(22) PCT Filed: May 9, 2018

(86) PCT No.: PCT/EP2018/061978
§ 371 (c)(1),
(2) Date: Nov. 5, 2019

(87) PCT Pub. No.: WO2018/206627
PCT Pub. Date: Nov. 15, 2018

(65) Prior Publication Data

US 2020/0063391 A1 Feb. 27, 2020

(30) Foreign Application Priority Data

May 11, 2017 (FR) ..... 1754141

(51) Int. Cl.
*E02D 3/115* (2006.01)
*E02D 3/12* (2006.01)

(52) U.S. Cl.
CPC ..... *E02D 3/115* (2013.01); *E02D 3/12* (2013.01)

(58) Field of Classification Search
CPC ..... E02D 3/12; E02D 3/115
See application file for complete search history.

(56) References Cited

U.S. PATENT DOCUMENTS 768,774 A * 8/1904 Schmidt ..... E02D 3/115 405/130
3,183,675 A * 5/1965 Schroeder ..... E02D 19/14 405/130

(Continued)

FOREIGN PATENT DOCUMENTS

CN 104695964 A 6/2015
CN 105862932 A 8/2016

(Continued)

OTHER PUBLICATIONS

Translation CN 104963334; ALL; 2015 (Year: 2015).*

(Continued)

*Primary Examiner* — Benjamin F Fiorello
(74) *Attorney, Agent, or Firm* — Pearne & Gordon LLP

(57) ABSTRACT

A method for freezing and treating a mass of soil, making it possible to compensate for deformations of the mass of soil during thawing, including the following steps: a) producing at least one bore (2) in the mass of soil, b) at least partly freezing the mass of soil using a freezing fluid injected into the bore, and then c) injecting a compensation grouting into the mass of soil, using the bore (2) that was used for freezing, during the thawing phase in order to at least partly compensate for variations in the volume of the mass of soil when the latter thaws.

11 Claims, 9 Drawing Sheets

(56) References Cited

U.S. PATENT DOCUMENTS

| | | | | |
|---|---|---|---|---|
| 3,720,065 | A * | 3/1973 | Sherard | E02D 3/10 405/130 |
| 3,726,095 | A * | 4/1973 | Ross | E02D 3/115 405/130 |
| 7,438,501 | B2 * | 10/2008 | Sopko | E02D 3/115 165/45 |
| 2007/0266715 | A1 * | 11/2007 | Sopko | E02D 19/14 62/66 |

FOREIGN PATENT DOCUMENTS

| | | | |
|---|---|---|---|
| JP | 2956526 | B2 | 10/1999 |
| JP | 3478638 | B2 | 10/2003 |
| JP | 104963334 | A | 10/2015 |
| TW | 2010-02913 | A | 1/2010 |

OTHER PUBLICATIONS

French Search Report dated Nov. 17, 2017 for corresponding French Application No. 1754141.
International Search Report dated Jun. 21, 2018 for corresponding International Application No. PCT/EP2018/061978.
Written Opinion dated Jun. 21, 2018 for corresponding International Application No. PCT/EP2018/061978.
Singapore Search Report and Written Opinion dated Sep. 23, 2020 for corresponding Singapore Application No. 11201910420R.

* cited by examiner

METHOD AND DEVICE FOR FREEZING A MASS OF SOIL

FIELD OF THE INVENTION

The present invention concerns the methods and the devices used to freeze soil.

BACKGROUND OF THE INVENTION

Freezing soil is a technique invented at the end of the 19th century for rendering a mass of soil coherent and impermeable. It is used nowadays to carry out excavations in non-cohesive, in particular powdery, ground containing for example gravel or sand, and containing a large quantity of interstitial water, possibly in circulation.

The general principle of this technique is to chill a mass of soil in such a way as to fix the interstitial water and thus to create a coherent and impermeable mass. To this end an array of bores is produced in the mass of soil to be frozen. The bores are equipped with freezing probes in which a fluid at low temperature is caused to circulate. The mass of soil to be frozen has its temperature lowered until a coherent and impermeable frozen mass of soil is obtained that is maintained at low temperature through the excavation operations. On completion of the works the freezing probes are purged and then removed or abandoned and the mass of soil rises slowly in temperature.

During freezing the water tends to disturb the mass of soil because of its increase in volume on changing state. It reduces in particular the overall compactness of the mass of soil and tends to push apart the grains constituting the soil.

When the previously frozen mass of soil rises in temperature its volume tends to decrease with the return of the water to the liquid state. Moreover, the cohesion of the mass of soil is reduced compared to the situation before freezing because of the separation of the grains of soil. These two phenomena lead to compacting of the frozen soil when it thaws.

In the frequent situation where neighbors on the surface are sensitive to compacting (in particular when the frozen zones are near buildings), it may be necessary to inject a compensation grouting. These injections are intended to compensate the compaction that could be produced at the surface when the volume of the frozen mass decreases. They are carried out by means of specific bores that are costly to produce.

Known from patent application CN 104963334 is a method of freezing soil to construct a tunnel in which cement is injected before freezing the ground to reinforce the latter.

There is a need for the benefit of a ground freezing method that is simpler to use and the invention aims to address this need.

BRIEF SUMMARY OF THE INVENTION

According to one of its aspects the invention therefore consists in a method for freezing and treating a mass of soil, making it possible to compensate for deformations of the mass of soil during thawing, including the following steps:

a) making at least one bore in the mass of soil, b) at least partly freezing the mass of soil using a freezing fluid injected into the bore, then c) injecting a compensation grouting into the mass of soil, using the bore that was used for freezing, during the thawing phase in order at least partly to compensate for variations in the volume of the mass of soil when the latter thaws.

The injection of the compensation grouting into the mass of soil during the thawing phase makes it possible to reinforce the mass of soil and to prevent ground movement and subsidence.

Reusing the bore used for freezing reduces the number of bores to be produced and renders the method simpler to carry out than those of the prior art.

The compensation grouting is preferably injected selectively, that is to say the timing and the point or points of injection of the compensation grouting are controlled as a function of the progress of the thawing of the mass of soil and the deformations of the latter or deformations induced at the surface.

The compensation grouting is preferably a cement grouting.

Drilling

During drilling, a drilling fluid may be used in order to favor the evacuation of the drilling mud. This drilling fluid is preferably water, but may be another fluid, in particular bentonite mud.

The bores may be produced by means of drilling tubes each equipped at its end with a drilling tool and each drilling tube may be left in place during the freezing process as far as the step of injecting the compensation grouting. The drilling tubes may therefore be used to inject the compensation grouting.

The drilling tool may be left in place and lost. Alternatively, it is withdrawn.

The drilling tube may be used for drilling, as mentioned hereinabove, that is to say used to drive the drilling tool, or alternatively introduced after drilling, when the nature of the soil allows this.

The drilling tube or tubes may be sleeved. In this case the tube includes one or more orifices normally covered and blocked by the sleeves. The latter are deformed by the pressure of the injected grouting, which they allow to exit via the associated orifice or orifices.

Alternatively, the or each orifice is formed by rupturing weakened thinner zones of the wall of the tube, which burst because of the pressure of the grouting.

The compensation grouting outlets may be distributed over the tube, for example disposed with a spacing between 50 cm and 5 m, better between 1 m and 4 m. The tube includes a grouting outlet every 2 m for example. It is possible with the aid of a plug introduced into the tube to isolate certain outlets and thereby to control the height of injection of the grouting into the mass of soil.

The sleeves may be protected during drilling by an external sheathing.

Alternatively, the drilling tube has no grouting outlets over its length. In this case it may be open at its distal end.

In a preferred embodiment, the bore being produced by means of a drilling tube with or without sleeves equipped at the end with a drilling tool, the drilling tube is left in place during the freezing step and during the step of injecting the compensation grouting.

Embedding

The or each drilling tube may be embedded in the mass of soil by injecting an embedding grouting into the bore around the drilling tube. This embedding step may take place after the drilling step and before the freezing step.

The embedding grouting is for example a cement grouting. This embedding grouting may in particular be identical to the compensation grouting. Alternatively, it is different. The injection pressure of the embedding grouting is fixed in order to prevent any ground movement. It is preferably less than the limit pressure of the enclosing ground to be treated.

The interior of the drilling tube may be cleaned in order to eliminate residual embedding grouting before the freezing operation.

Freezing

The freezing operation is preferably effected by introducing a freezing probe into each of the bores using the drilling tube or tubes in place.

A space produced around the freezing probe in the drilling tube may be filled with a thermally conductive fluid. This thermally conductive fluid is for example brine. Alternatively, the space may be filled with a liquid substance at the freezing temperature of the ground, for example an appropriate polymer.

Before introducing the thermally conductive fluid, the overall seal may be tested to verify the absence of leaks. A test of this kind may be effected with water. It is in particular intended to verify the absence of leaks of the thermally conductive fluid into the ground any such leaks making it impossible to freeze the ground.

The freezing probe is fixed to the drilling tube by fixing means that enable its mechanical retention. These fixing means may also provide the seal for the thermally conductive fluid present around the freezing probe in the drilling tube.

Alternatively, the freezing probe is introduced into the corresponding bore without there being a drilling tube present, parallel to a pipe used to inject the compensation grouting.

In one embodiment the tube used to inject the compensation grouting and the freezing probe are embedded one beside the other in the bore by means of an embedding grouting. A configuration of this kind may be chosen in the case of a sufficiently coherent mass of soil. The embedding grouting may be injected into the aforementioned tube until the grouting rises sufficiently around the latter in the bore.

The method according to the invention includes the step of freezing the mass of soil during which a freezing fluid may be caused to circulate in the freezing probe. The freezing fluid may be brine or liquid nitrogen.

The nature of the freezing fluid may be modified during the process. In a first phase, liquid nitrogen is used as the freezing fluid, for example, in order to cause rapid cooling, after which in a second phase of the process brine is used as the freezing fluid.

The method may include a step of draining the thermally conductive fluid present around the freezing probe in the drilling tube.

The method may further include a step of withdrawing the freezing probe before the step of injecting the compensation grouting. The freezing probe can therefore be withdrawn before introducing a tube for injecting the compensation grouting.

The freezing probe may include an outer tube and an inner tube disposed inside the outer tube. The freezing probe may therefore include an inlet for freezing fluid into the inner tube and for evacuation of the freezing fluid via the gap between the outer tube and the inner tube. The outer and inner tubes may be coaxial or not. In a variant embodiment the inner and/or outer tube(s) of the freezing probe is/are not withdrawn during injection of the compensation grouting. The freezing probe may therefore be left in place and lost.

Compensation

The compensation grouting is injected at a pressure sufficient to fracture the embedding grouting and to burst the thawed and decompressed ground. The injection pressure of the compensation grouting is preferably greater than the limit pressure of the ground changed by thawing it.

In the method according to the invention the compensation grouting may be injected with the aid of an injection tube introduced via a plug disposed in the drilling tube.

The compensation grouting may be injected in succession at at least two levels in the mass of soil, for example by moving the plug in the drilling tube and using outlets located at at least two different heights on the drilling tube.

The method according to the invention may include a step of measuring deformations at the surface of the soil, in particular by means of one or more sensors. These measurements enable surveillance of any compaction of the mass of soil and possible creep phenomena. The measurements obtained can enable adjustment of the injection of the compensation grouting, and in particular the injection pressure and the injection height in the bores.

The injection of the compensation grouting may be continued until the end of thawing the soil. The mass of soil may be left to thaw to around −2 to 5° C. before proceeding to inject the compensation grouting.

The drilling tube may be cleaned after injecting the compensation grouting. In particular, the method may include a step of cleaning the drilling tube after complete thawing of the soil.

Drilling Device

Independently of or in combination with what is described above, the invention further consists in a drilling device, in particular for carrying out the method as defined above, including a drilling tube, with or without sleeves, equipped at the end with a drilling tool, and a tube for injecting a compensation grouting.

This device may include at least one plug for selecting the height of injection of the compensation grouting into the bore.

Independently of or in combination with what is described above, the invention further consists in a system for freezing soil including a drilling device as defined hereinabove and a freezing probe. The latter may be produced in such a way that it can be fixed to the drilling tube by a mechanical connection that is sealed at the level of the entry of the bore.

Independently of or in combination with what is described above, the invention further consists in an assembly designed for execution of the method as described above, including a drilling tube equipped with a drilling tool, a tube for injecting compensation grouting, the drilling tube being configured to receive the injection tube during the thawing phase, and a freezing probe configured to be fixed removably in the drilling tube.

Independently of or in combination with what is described above, the invention further consists in a system for executing the method defined above including a drilling tube with or without sleeves equipped with a drilling tool and a freezing probe configured to be removably fixed in the drilling tube.

The system may be rendered thermally continuous by filling with a thermally conductive fluid remaining liquid at the soil freezing temperature.

Independently of or in combination with what is described above, the invention further consists in a mass of soil treated by means of the method defined above, including a compensation grouting injected around the bore, in particular at the level of the outlets of the drilling tube. The bores may be disposed in various manners, for example horizontally or radially, for example around a tunnel.

DESCRIPTION OF THE FIGURES

Other features and advantages of the present invention will emerge on reading the following detailed description of nonlimiting embodiments thereof and examining the appended drawings, in which:

FIGS. 2 to 8 are views analogous to FIG. 1 illustrating the freezing and treatment method according to the invention, and FIGS. 2*a* to 6*a* are cross sections taken along the line A-A in FIGS. 2 to 6, respectively.

DESCRIPTION OF EXAMPLE EMBODIMENTS

Figures 1, 1A:
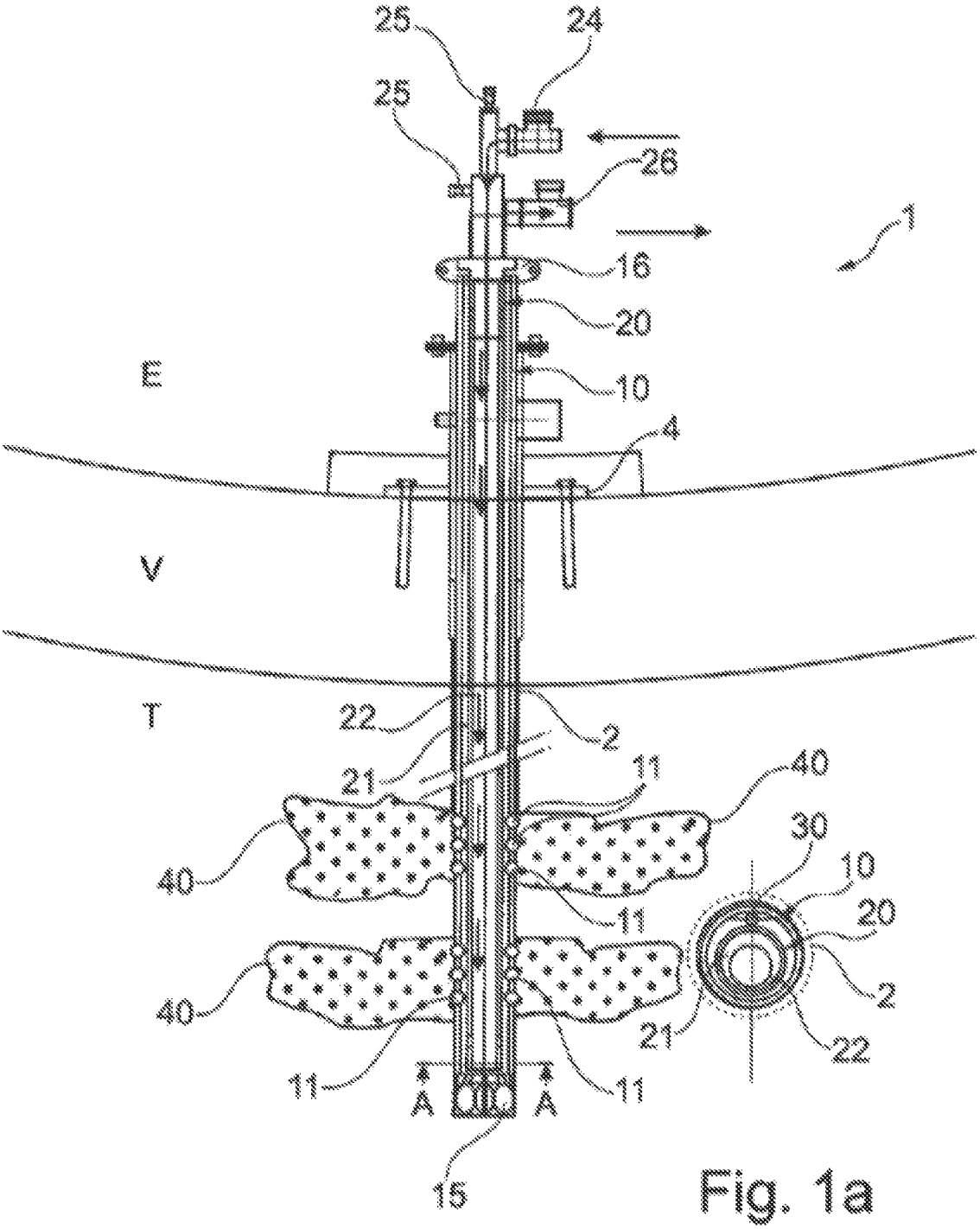
FIG. 1 is a diagrammatic partial view in longitudinal section of a drilling device according to the invention.
FIG. 1*a* is a cross section taken along the line A-A in FIG. 1, FIGS. 1*b* and 1*c* are views analogous to FIG. 1*a* of variant embodiments.

There has been shown in FIGS. 1 and 1*a* a drilling device 1 in place in a bore 2 produced in a mass of soil T. A segment V may be present, as shown, the drilling device 1, which remains accessible externally E, passing through it.

The drilling device 1 is for example fixed to the segment V by a plate 4 that in the example described is curved to follow the curvature of the latter. Of course, the mass of soil T may have no segment V.

The drilling device 1 includes a drilling tube 10 which in the example described is equipped at the end with a drilling tool 15.

The tube 10 receives a freezing probe 20 mechanically coupled to the drilling tube 10 by a connecting strapping 16. The freezing probe 20 is configured to allow the circulation of a cold fluid, namely brine in the example considered.

The freezing probe 20 includes an outer tube 21 and an inner tube 22 disposed inside the outer tube 21. The fluid circulates between an inlet 24 and an outlet 26, in the direction of the arrows, namely descends inside the tube 22 and rises via the tube 21 around the tube 22. The freezing probe 20 may as shown include purge valves 25.

The tube 10 is provided in this example with outlets consisting of orifices made through the wall at various heights, these orifices being normally blocked by sleeves 11.

The drilling tube 10 enables reception of a tube 30 for injecting compensation grouting and preferably includes means for selecting the height of injection of the compensation grouting into the bore by enabling selection of the grouting outlet orifices thanks to at least one plug, as described later.

Figure 1C:
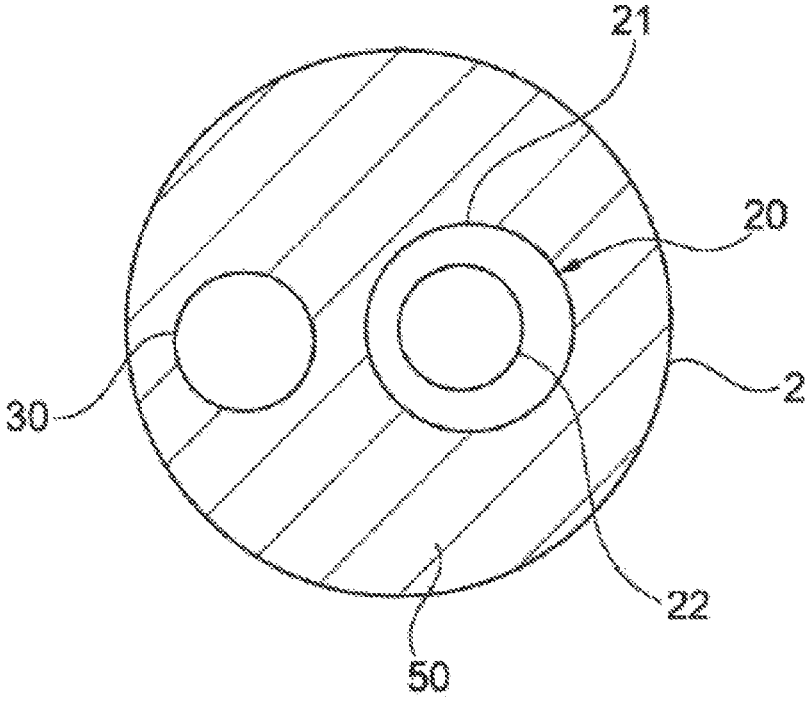
Figure 1B:
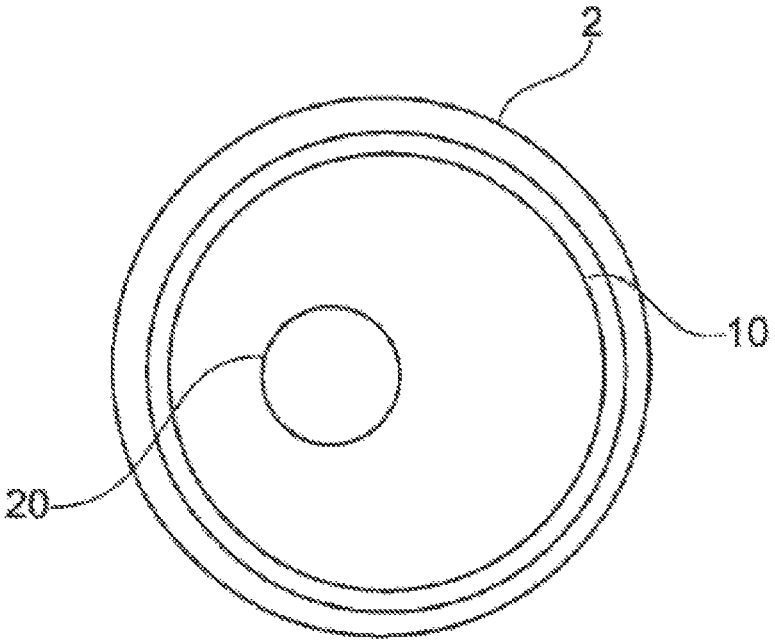

In the variant shown in FIG. 1*b*, the freezing probe introduced into the drilling tube 10 includes only one tube instead of an inner tube and an outer tube. In this case, the freezing fluid arrives via this single tube and exits via the exterior inside the drilling tube 10.

In the variant from FIG. 1*c* the mass of soil is sufficiently coherent for it not to be necessary to leave the drilling tube 10 in place. In this case, the compensation grouting injection tube 30 and the freezing probe 20 may be embedded one beside the other in the bore 2 by means of an embedding grouting.

The freezing method using the device from FIG. 1 will now be described in more detail with reference to FIGS. 2 to 8 and 2*a* to 6*a*.

Figures 2, 2A:
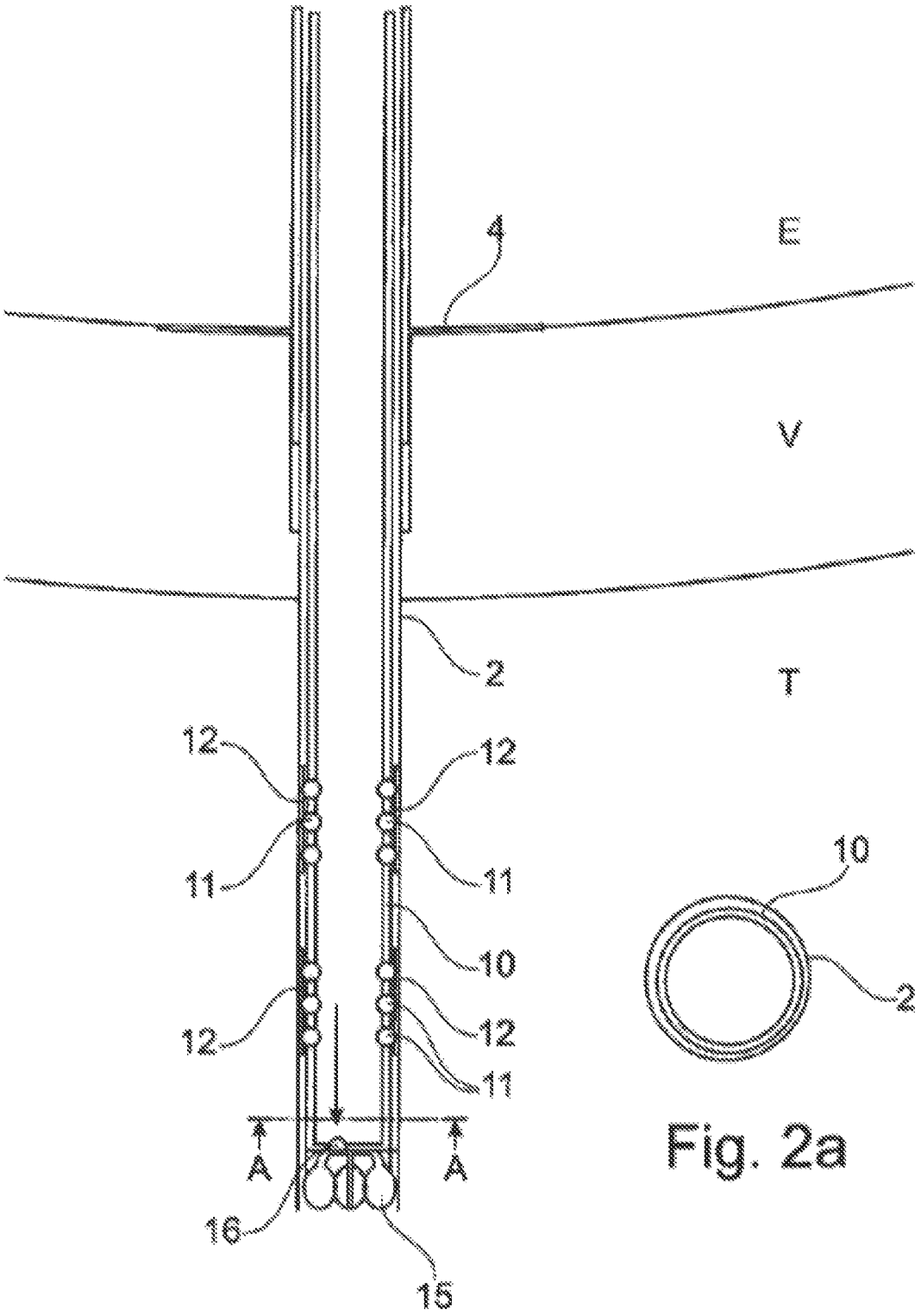

In a first embodiment shown in FIGS. 2 and 2*a* at least one bore 2 is produced in the mass of soil. The drilling tube 10 equipped at the end with a drilling tool 15 is used for this purpose. During drilling, the sleeves 11 are preferably protected, as shown, by protective sheaths 12 that cover them.

The drilling tube 10 may be lubricated during the drilling operation in a manner known in itself thanks to a check valve 16 placed at the bottom of the drilling tube 10 that enables water to be injected onto the tool 15.

Figures 3, 3A:
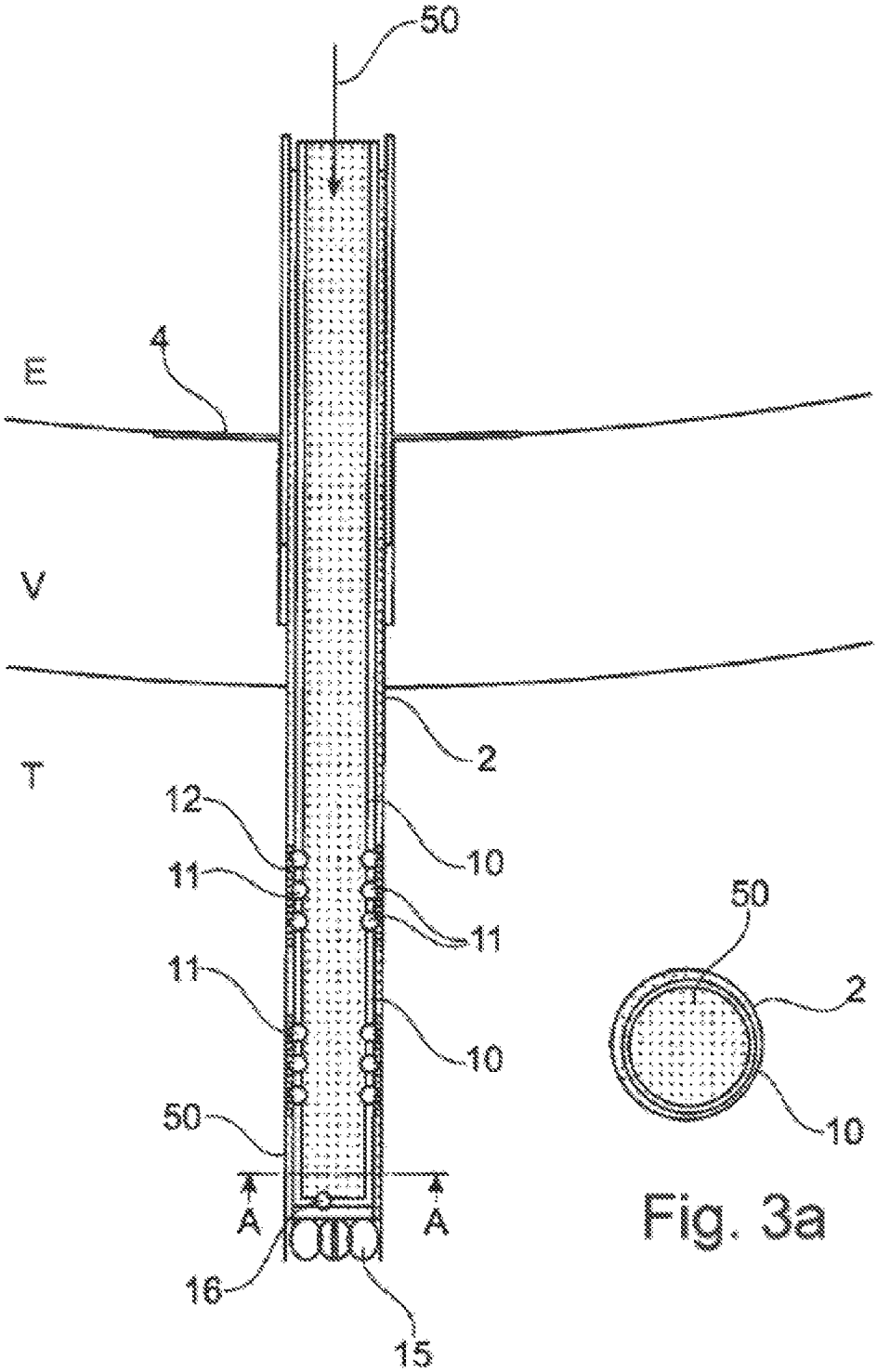

In a second step shown in FIGS. 3 and 3*a* the drilling tube 10 may be embedded in the bore 2 by injecting an embedding grouting 50. The latter is injected into the drilling tube 10 and expands outside it via the valve 16.

Figures 4, 4A:
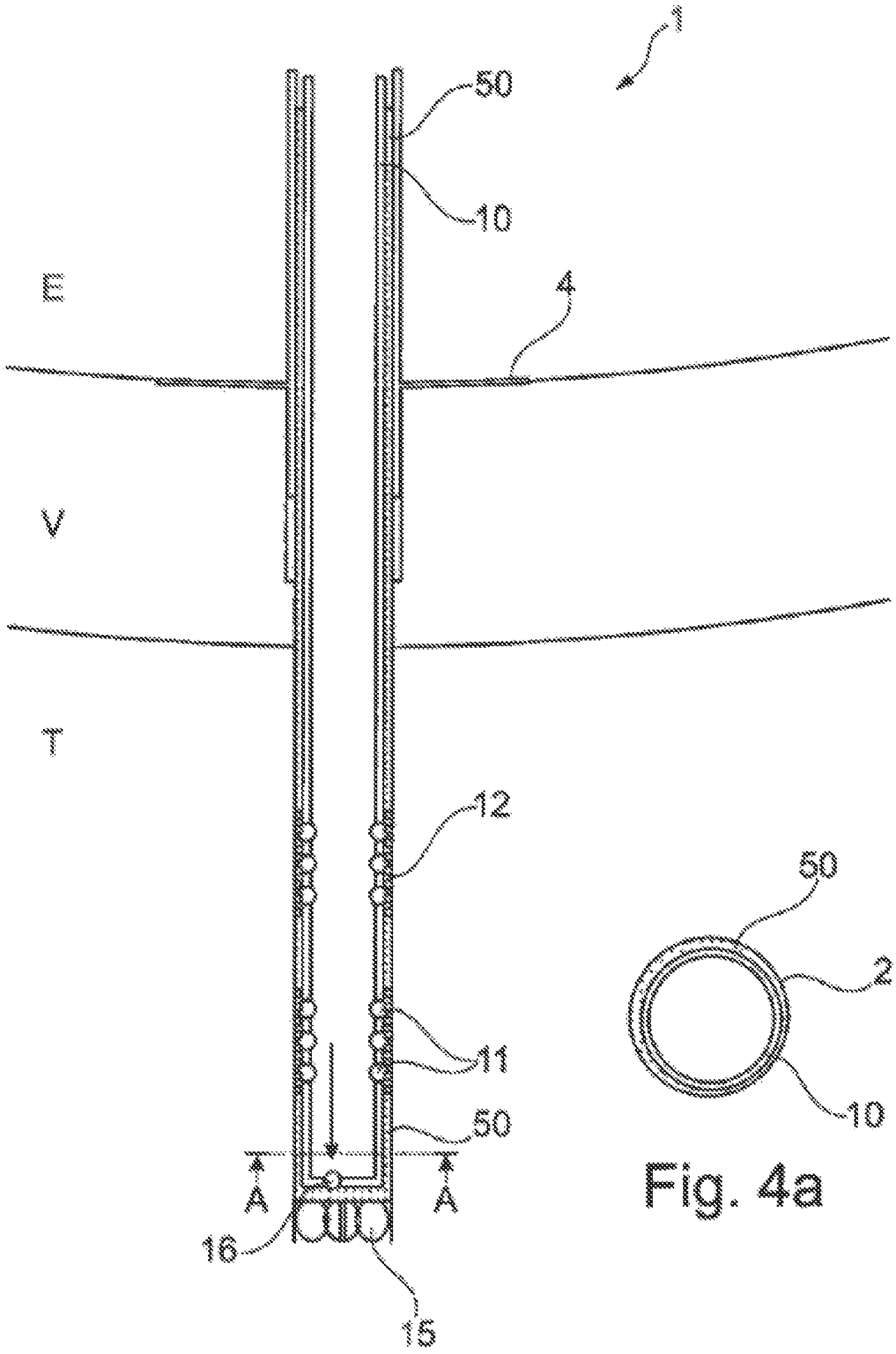

Residual embedding grouting inside the drilling tube 10 is then eliminated to leave only the useful embedding grouting 50, namely that situated between the wall of the bore 2 and the outside of the drilling tube 10, as shown in FIGS. 4 and 4*a*.

The freezing operation is effected by first introducing the freezing probe 20 described above into the drilling tube 10 as shown in FIGS. 5 and 5*a*. The annular void between the probe 20 and the tube 10 is filled with a thermally conductive fluid, for example brine, so as to provide satisfactory thermal conductivity between the two and thereby to favor the cooling of the latter.

Before effecting this filling, the seal of the embedding of the drilling tube to the ground may be tested with water so as not to introduce into the ground a fluid that cannot be frozen.

Figure 5:
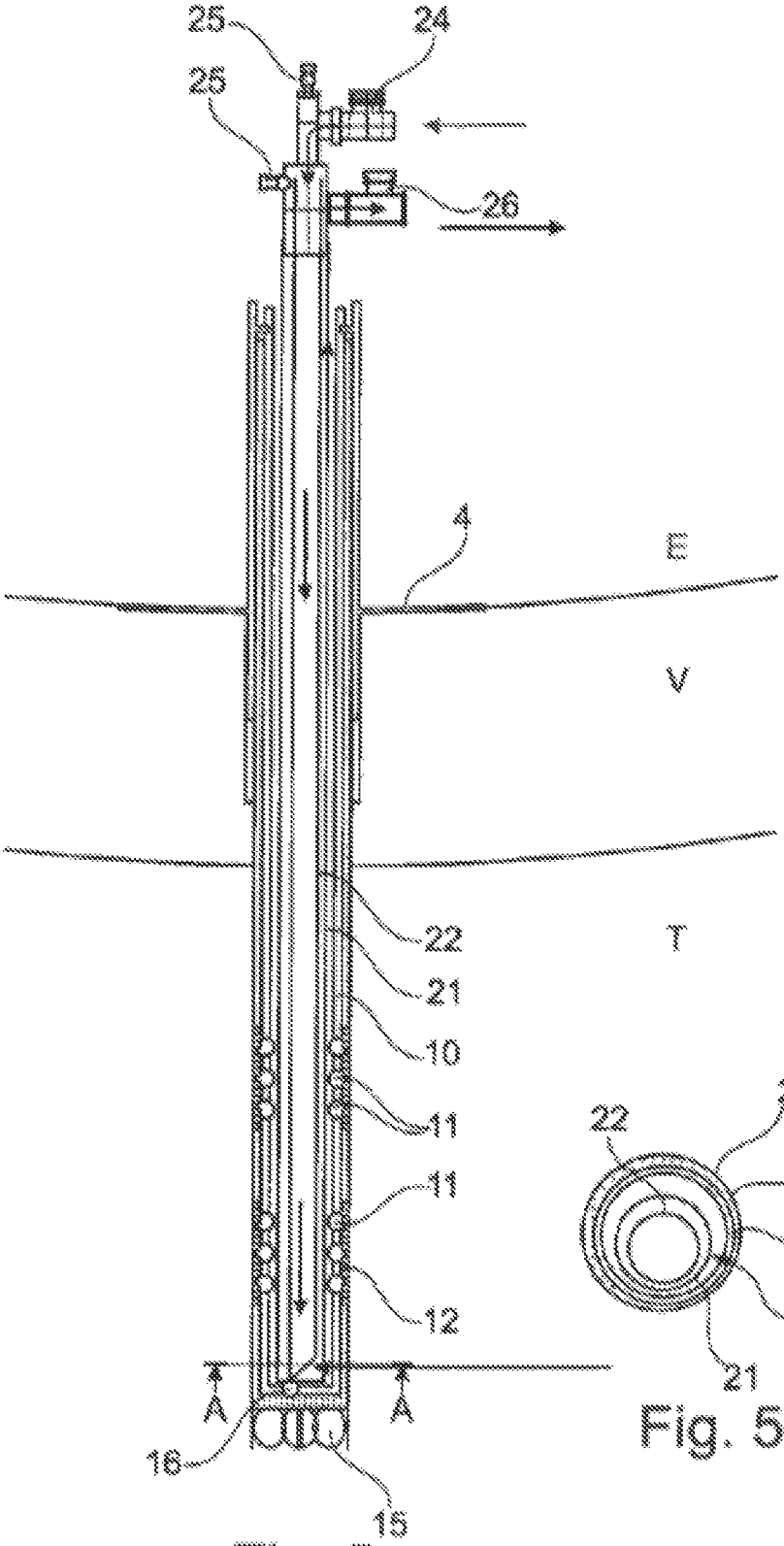
Figure 5A:
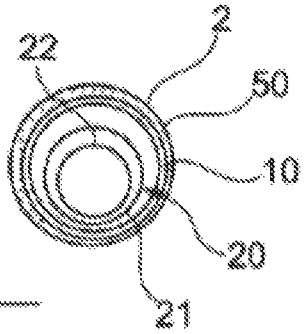

The method then includes the step of chilling and freezing the mass of soil, during which a cryogenic fluid, in particular brine, is caused to circulate in the freezing probe, as shown in FIGS. 5 and 5*a*. The latter circulates in the probe between the inlet 24 and the outlet 26.

When chilling is not necessary the thermally conductive fluid present around the freezing probe in the drilling tube 10 may be drained and the freezing probe withdrawn.

Figure 6:
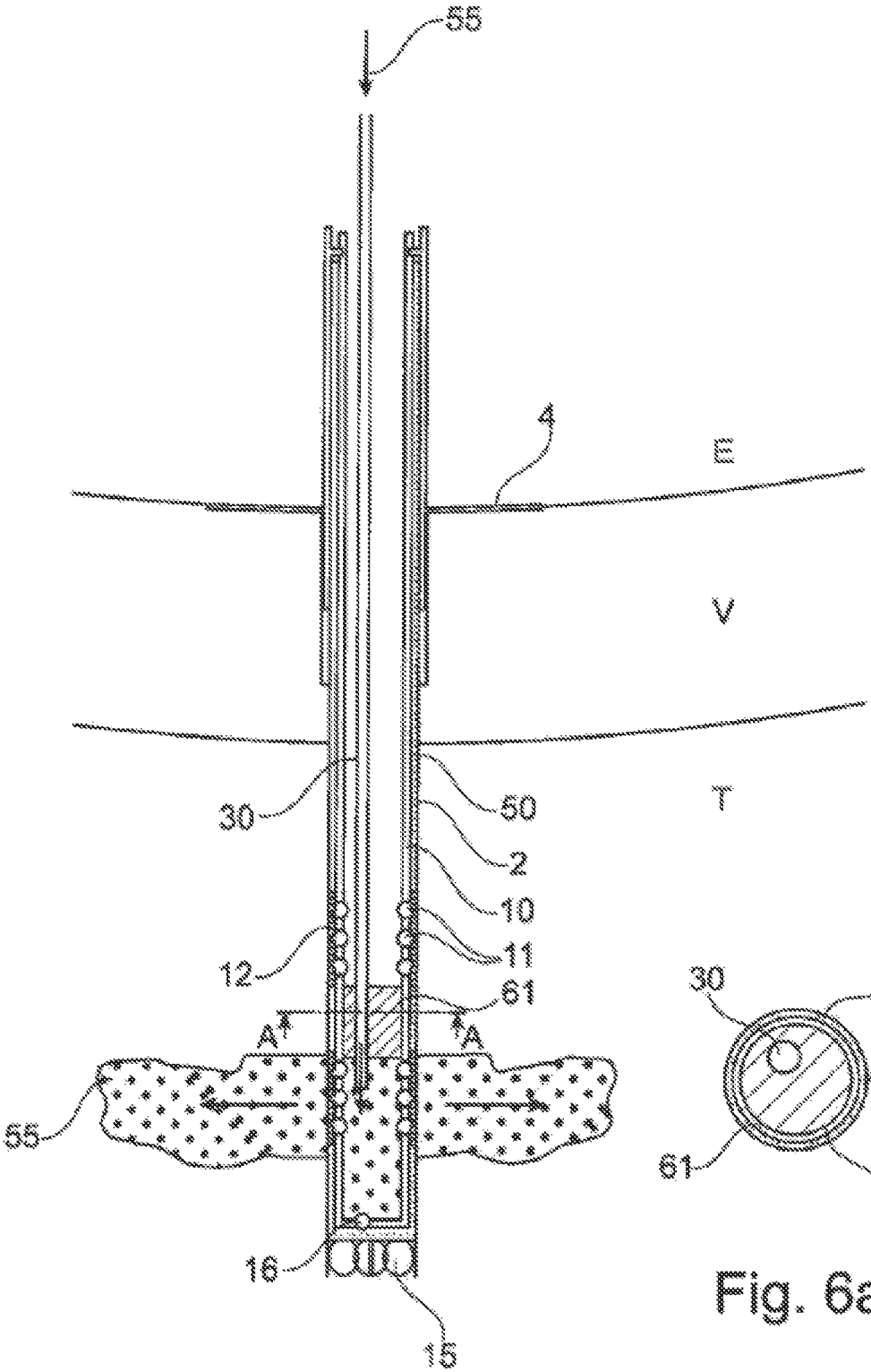
Figure 6A:
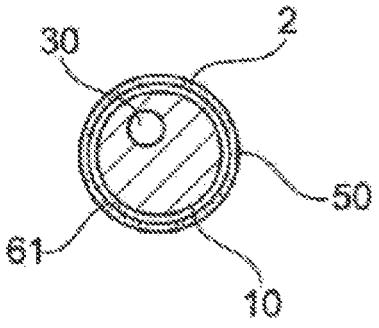

The compensation grouting injection tube 30 is then introduced into the drilling tube 10, as shown in FIGS. 6 and 6*a*.

A plug 61 may be placed in the drilling tube 10 so that the grouting exits only via the orifices of the tube 10 situated short of the plug 61. The latter is for example an inflatable bladder through which the injection tube 30 passes.

Compensation grouting 55 is then injected into the mass of soil with the aid of the tube 30, using the bore 2 that was used for freezing.

During injection of the compensation grouting the sheaths 12 protecting the sleeves 11 are expelled by the injection pressure. At the level of the orifices covered by the sleeves 11 the embedding grouting 50 bursts enabling the compensation grouting to pass because of the high pressure used to inject the latter.

In FIG. 6 the plug 61 is disposed so that the compensation grouting is injected via the lowest outlets of the tube 10.

Figure 7:
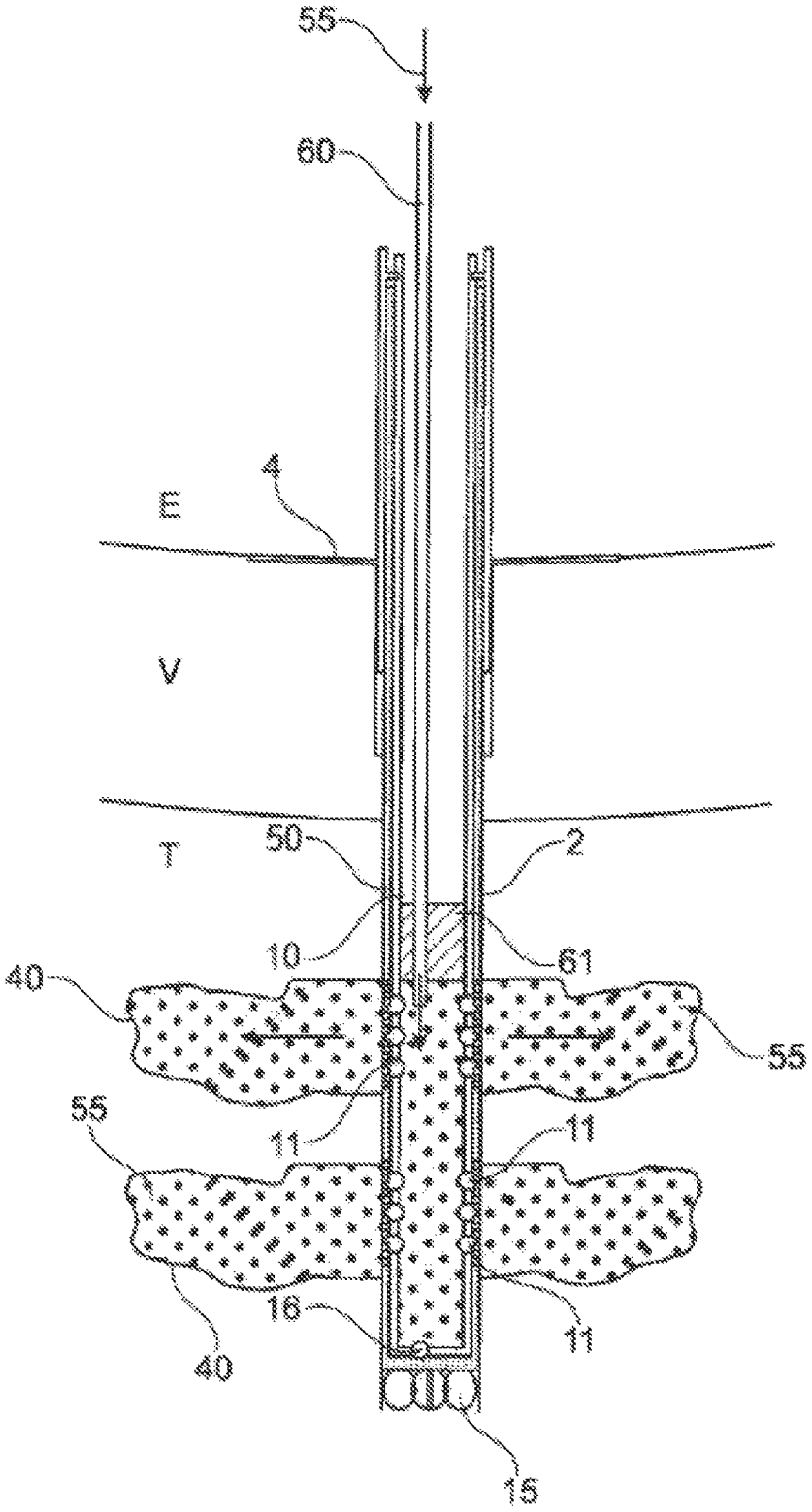

The compensation grouting may nevertheless be injected at at least two different levels into the mass of soil, as shown in FIG. 7, rising once injection via the lowest outlets is finished, the plug 61 in the drilling tube 10 above other outlets. Other plugs may moreover be disposed so as to select the zones of the drilling tube where it is wished to inject the cement grouting.

Injection may therefore be carried out selectively, and the timing and the depth of injection of compensation grouting may be controlled as a function of the progress of the thawing of the mass of soil and the evolution of the stability of the latter.

Bulbs 40 of compensation grouting are obtained around the bore 2, in particular at the level of the sleeves 11 of the drilling tube 10.

Figure 8:
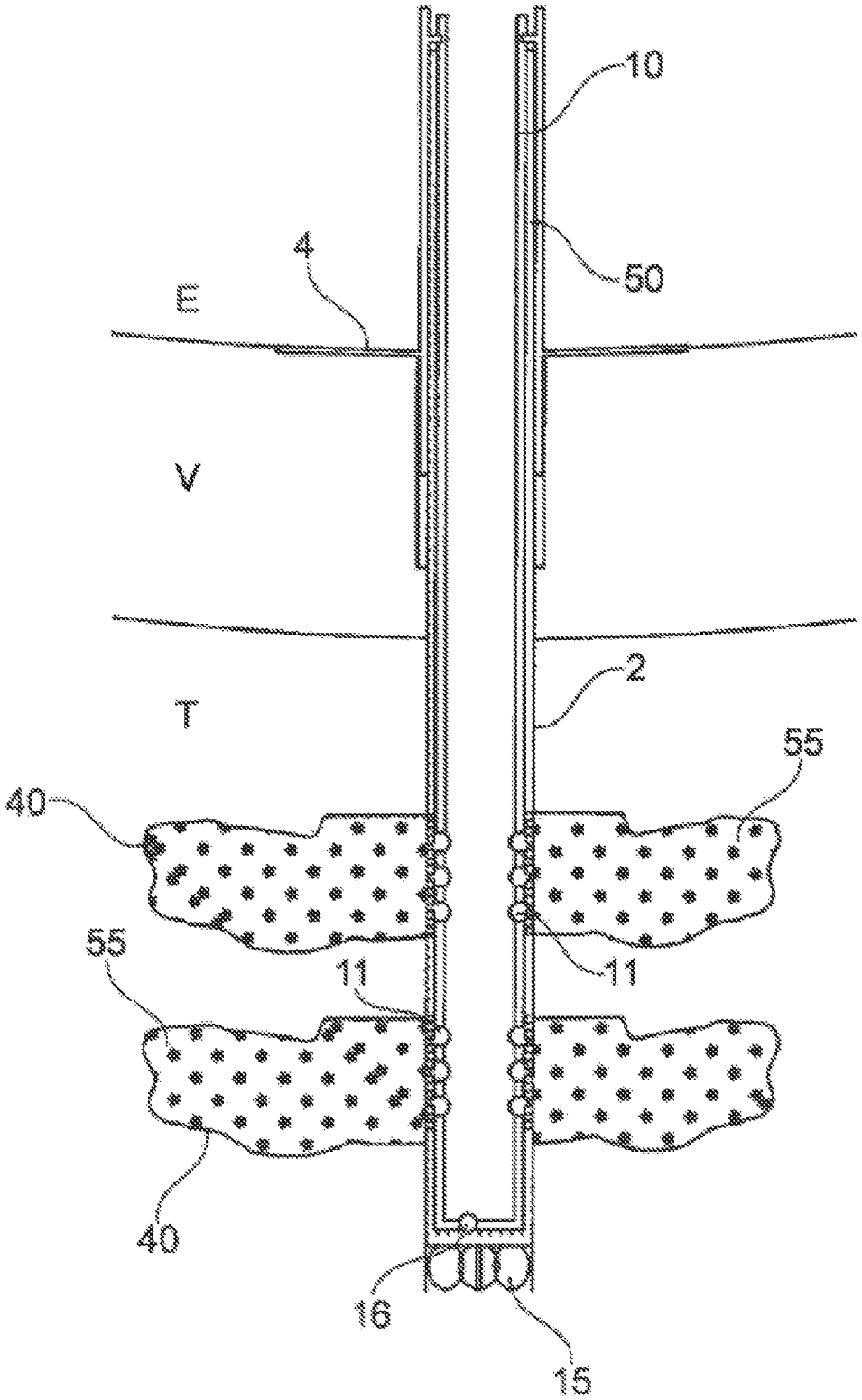

Finally, in a final step shown in FIG. 8, the drilling tube 10 may be cleaned after injection of the compensation grouting 55.

Of course the invention is not limited to that examples that have just been described and the drilling tube as well as the freezing probe may be produced differently without departing from the scope of the present invention. The freezing probe is for example adapted to circulate liquid nitrogen. The drilling tube may have no sleeves or be configured differently.

The invention claimed is:

1. A method for freezing and treating a mass of soil, making it possible to compensate for deformations of the mass of soil during thawing, including the following steps:

a) producing at least one bore in the mass of soil, b) at least partly freezing the mass of soil using a freezing fluid injected into the bore, and then c) injecting a compensation grouting into the mass of soil, using the bore that was used for freezing, during the thawing phase in order to at least partly compensate for variations in the volume of the mass of soil when the latter thaws, the bore being produced by means of a drilling tube with or without sleeves equipped at the end with a drilling tool, the drilling tube being left in place during the freezing step and during the step of injecting the compensation grouting, and the drilling tube being embedded in the mass of soil by injecting an embedding grouting and then being cleanable to drain it off the embedding grouting before the freezing operation.

2. The method as claimed in 1, the compensation grouting being injected at a pressure sufficient to fracture the embedding grouting.

3. The method as claimed in claim 1, the freezing operation being performed by introducing a freezing probe into the bore.

4. The method as claimed in claim 3, in which a thermally conductive fluid is used to fill a space provided around the freezing probe in the drilling tube.

5. The method as claimed in claim 3, the freezing probe including an outer tube and an inner tube disposed inside the outer tube.

6. The method as claimed in claim 1, the compensation grouting being injected with the aid of an injection tube introduced via a plug disposed in the drilling tube.

7. The method as claimed in claim 6, the compensation grouting being injected at least two levels into the mass of soil, by moving the plug in the drilling tube and using orifices of the latter located at least two different heights on the tube.

8. The method as claimed in claim 1, the freezing operation being performed by introducing a freezing probe into the drilling tube in place.

9. An assembly designed for execution of the method as claimed in claim 1, including a drilling tube equipped with a drilling tool, a tube for injecting compensation grouting, the drilling tube being configured to receive the injection tube during the thawing phase, and a freezing probe configured to be fixed removably in the drilling tube.

10. A method for freezing and treating a mass of soil, making it possible to compensate for deformations of the mass of soil during thawing, including the following steps:

a) producing at least one bore in the mass of soil, b) at least partly freezing the mass of soil using a freezing fluid injected into the bore, and then c) injecting a compensation grouting into the mass of soil, using the bore that was used for freezing, during the thawing phase in order to at least partly compensate for variations in the volume of the mass of soil when the latter thaws, the freezing operation being performed by introducing a freezing probe into the bore, the method including a step of withdrawing the freezing probe before injecting the compensation grouting.

11. An assembly for freezing and treating a mass of soil, making it possible to compensate for deformations of the mass of soil during thawing, including the following steps:

a) producing at least one bore in the mass of soil, b) at least partly freezing the mass of soil using a freezing fluid injected into the bore, and then c) injecting a compensation grouting into the mass of soil, using the bore that was used for freezing, during the thawing phase in order to at least partly compensate for variations in the volume of the mass of soil when the latter thaws, the freezing operation being performed by introducing a freezing probe into the bore, the freezing probe including an outer tube and an inner tube disposed inside the outer tube.

* * * * *